US007128171B2

(12) United States Patent
Dick et al.

(10) Patent No.: US 7,128,171 B2
(45) Date of Patent: Oct. 31, 2006

(54) HYDRODYNAMIC PUMP PASSAGES FOR ROLLING CONE DRILL BIT

(75) Inventors: Aaron J. Dick, Houston, TX (US); Chih C. Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 165 days.

(21) Appl. No.: 10/784,339

(22) Filed: Feb. 23, 2004

(65) Prior Publication Data

US 2005/0183888 A1 Aug. 25, 2005

(51) Int. Cl.
*E21B 10/24* (2006.01)
*E21B 10/18* (2006.01)

(52) U.S. Cl. ..... 175/228; 175/337; 175/339; 384/93

(58) Field of Classification Search ..... 175/228, 175/337, 339, 372; 384/93
See application file for complete search history.

(56) References Cited

U.S. PATENT DOCUMENTS 3,244,459 A 4/1966 Ortloff
3,845,994 A 11/1974 Trey
3,890,018 A * 6/1975 Clamon ..... 384/92
4,061,376 A * 12/1977 Villaloboz ..... 172/228
4,167,219 A 9/1979 McQueen
4,167,220 A 9/1979 Ernst et al.
4,181,185 A 1/1980 Keller et al.
4,183,416 A 1/1980 Walters
4,207,658 A 6/1980 Sorenson
4,220,377 A * 9/1980 Phelps ..... 384/96
4,240,674 A 12/1980 Evans
4,252,383 A * 2/1981 Simpson ..... 384/93
4,412,590 A 11/1983 Daly
4,446,933 A 5/1984 Bodine
4,448,268 A 5/1984 Fuller
4,501,338 A 2/1985 Underwood
4,514,098 A * 4/1985 Ippolito ..... 384/95
4,572,306 A 2/1986 Dorosz
4,688,651 A 8/1987 Dysart
4,765,205 A 8/1988 Higdon
5,099,932 A 3/1992 Hixon
5,186,267 A 2/1993 White
5,441,120 A 8/1995 Dysart
5,593,231 A 1/1997 Ippolito (Continued)

FOREIGN PATENT DOCUMENTS

EP 0289668 11/1988

(Continued)

OTHER PUBLICATIONS

*Fundamentals of Fluid Film Lubrication*, by Bernard J. Hamrock, The Ohio State University, Columbus, Ohio, Chapter 10, Hydrodynamic Journal Bearings-Analytical Solutions, pp. 217-229.

*Primary Examiner*—Kenneth Thompson
(74) *Attorney, Agent, or Firm*—Bracewell & Giuliani LLP

(57) ABSTRACT

An earth boring bit has rotating cones with two lubricant passages to increase bearing capacity and cause lubricant circulation. A lubricant reservoir in the body supplies lubricant to passages between the cone and bearing pin. A pressure compensator equalizes lubricant pressure to the exterior of the bit. A first passage leads from the reservoir to the upper side of the bearing pin. A second passage leads from the reservoir to the bearing pin at a point from 185 degrees to 225 degrees as seen from an inner end of the bearing pin. This point is located in a diverging region 51*d* of an annular clearance surrounding the bearing pin.

23 Claims, 4 Drawing Sheets

U.S. PATENT DOCUMENTS

| | | | |
|---|---|---|---|
| 5,628,375 | A | 5/1997 | Daly |
| 5,927,439 | A | 7/1999 | Hanns |
| 5,931,241 | A | 8/1999 | Daly |
| 6,460,635 | B1 | 10/2002 | Kalsi et al. |

FOREIGN PATENT DOCUMENTS

| | | | |
|---|---|---|---|
| GB | 2355747 | A | 5/2001 |

* cited by examiner

Fig. 2
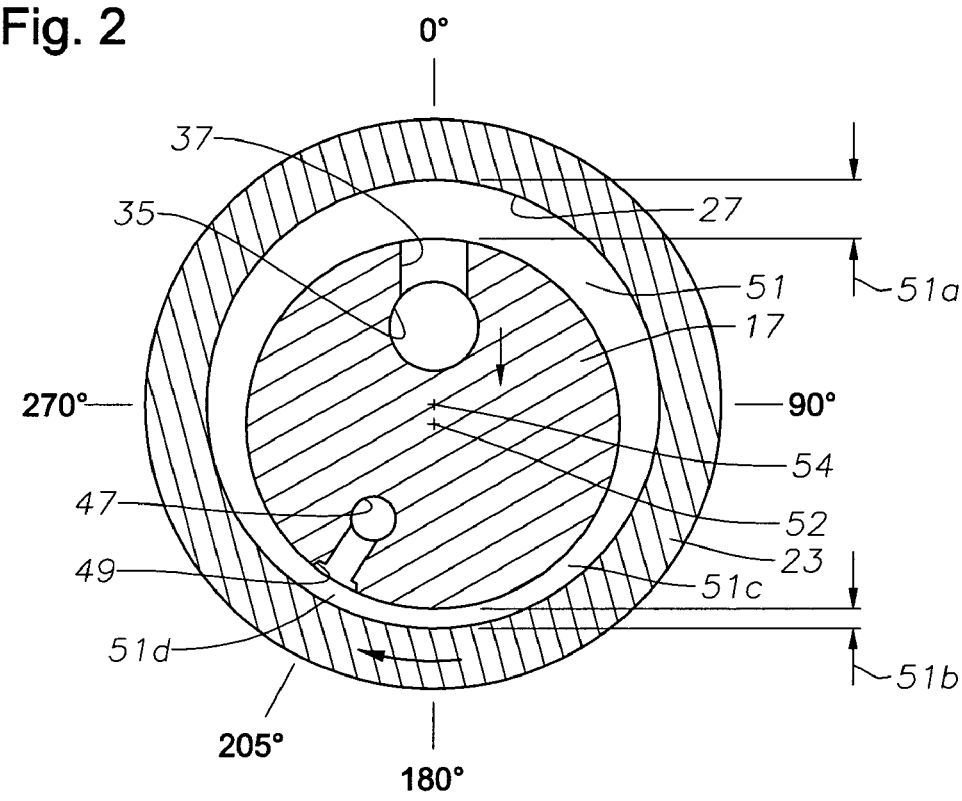
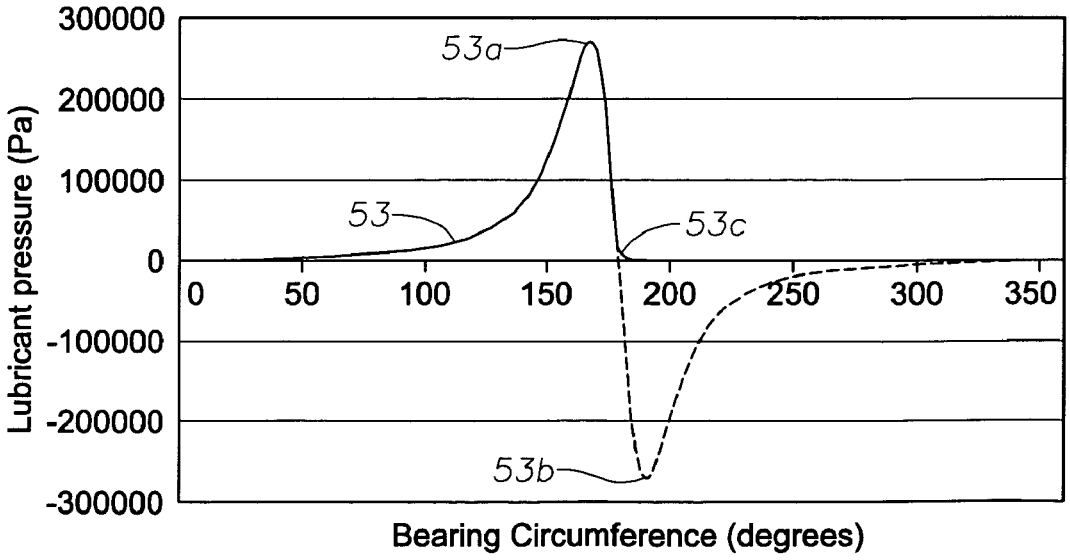
Fig. 3

HYDRODYNAMIC PUMP PASSAGES FOR ROLLING CONE DRILL BIT

FIELD OF THE INVENTION

This invention relates in general to earth boring drill bits, and in particular to a rotating cone drill bit that has passages within it to cause circulation of lubricant and increase bearing capacity.

DESCRIPTION OF THE PRIOR ART

A rolling cone earth boring bit has a bit body with at least one bit leg, typically three. The bit legs extend downward from the body. A bearing pin extends inward and downward from each bit leg. Each bearing pin is a cylindrical and rotatably receives a cone. Typically, the bearing is a journal bearing with the surfaces of the bearing pin and the cone cavity being in sliding rotational contact. Inlays may be utilized in the bearing areas to enhance the life of the bearing.

The cone has teeth or compacts on its exterior for disintegrating the earth formations as the cone rotates on the bearing pin. A lubricant reservoir in the bit body supplies lubricant to the bearing pin. A seal prevents debris and blocks the lubricant from leaking to the exterior. When operated in a borehole filled with liquid, hydrostatic pressure will act on the drill bit as a result of the weight of the column of drilling fluid. A pressure compensator in each bearing pin is mounted in each lubricant reservoir in the bit body. A lubricant passage extends from the reservoir of the compensator to an exterior portion of the bearing pin. The pressure compensator has a communication port that communicates with the hydrostatic pressure on the exterior to equalize the pressure on the exterior with lubricant pressure in the passages and clearances within the drill bit.

Drill bits of this nature operate under extreme conditions. Very heavy weights are imposed on the drill bit to cause the cutting action. Friction causes the drill bit to generate heat. Also, the temperatures in the well can be several hundred degrees Fahrenheit. Improvements in cutting structure have allowed drill bits to operate effectively much longer than in the past. Engineers involved in rock bit design continually seek improvements to the bearings to avoid bearing failure before the cutting structure wears out. There has been a variety of patented proposals to cause circulation of the lubricant. Also, flats, presumably to retain lubricant, have been employed in at least one bit on the unloaded or generally upper side of the journal surface of the bearing pin. Passages led from the other areas of the lubricant system to these flats.

In a conventional prior art bit, even though the clearance between the cone cavity and the bearing pin is quite small, the high load imposed on the drill bit causes the cone to be slightly eccentric relative to the bearing pin. The clearance is smaller on the lower side of the bearing pin than on the upper side. A lubricant pressure profile can be derived based on the pressure of the lubricant at each point circumferentially around the bearing pin. In prior art journal bearings in general, the lubricant pressure profile gradually increases to a positive peak at approximately bottom dead center because of the convergence of the clearance. A negative peak follows immediately afterward due to the divergence or increase of the clearance. The negative peak has a pressure that is negative relative to the ambient pressure of the lubricant. This type of lubricant pressure profile may be referred to as a full Sommerfeld solution. The negative peak has a disadvantage in that it reduces the bearing capacity.

SUMMARY OF THE INVENTION

The earth boring bit of this invention is a rotating cone type. A lubricant reservoir in the body supplies lubricant to a small annular clearance between the cone cavity and the exterior of the bearing pin. A first passage extends from the lubricant reservoir to an exterior portion of the bearing pin for communication of lubricant.

A recess is located on the bearing pin at a point in the range from 185 to 225 degrees, as viewed from the outer end of the bearing pin. The position of the recess is selected based on the lubricant pressure profile of the drill bit. A drill bit bearing has an annular clearance with a minimum clearance on its loaded side and a maximum clearance on its unloaded side. The clearance has a converging zone leading to a minimum clearance point and a diverging zone leading from the minimum clearance point. The lubricant pressure in the clearance increases rapidly in the converging zone near the minimum clearance point and decreases rapidly in the diverging zone immediately following the minimum clearance point. The recess is located where the pressure rapidly decreases. By communicating lubricant reservoir pressure directly to the point where the prior art negative peak would normally occur, the negative peak is reduced or eliminated. This elimination increases the load capacity of the bearing.

In the preferred embodiment, a passage extends from the recess to the lubricant reservoir. The passage communicates lubricant reservoir pressure to the recess to prevent the negative peak. By communicating the recess with the lubricant reservoir, the passage enhances circulation of lubricant.

In a second embodiment, the recess comprises a groove on the bearing pin without a passage leading to it. The groove has a volume that reduces or eliminates the negative peak. The groove enhances bearing capacity.

In a third embodiment, a passage leads from the recess to an unloaded side of the bearing, which is at approximately the same pressure as the lubricant reservoir. The passage communicates the lubricant reservoir pressure to the recess to avoid the negative pressure peak.

BRIEF DESCRIPTION OF THE DRAWINGS

FIG. 2 is a sectional view of the drill bit of FIG. 1, taken along the line 2—2 of FIG. 1.

FIG. 3 shows a pressure profile for the drill bit of FIG. 1, with the dotted line showing a pressure profile of a conventional drill bit.

DETAILED DESCRIPTION OF THE INVENTION

Figure 1:
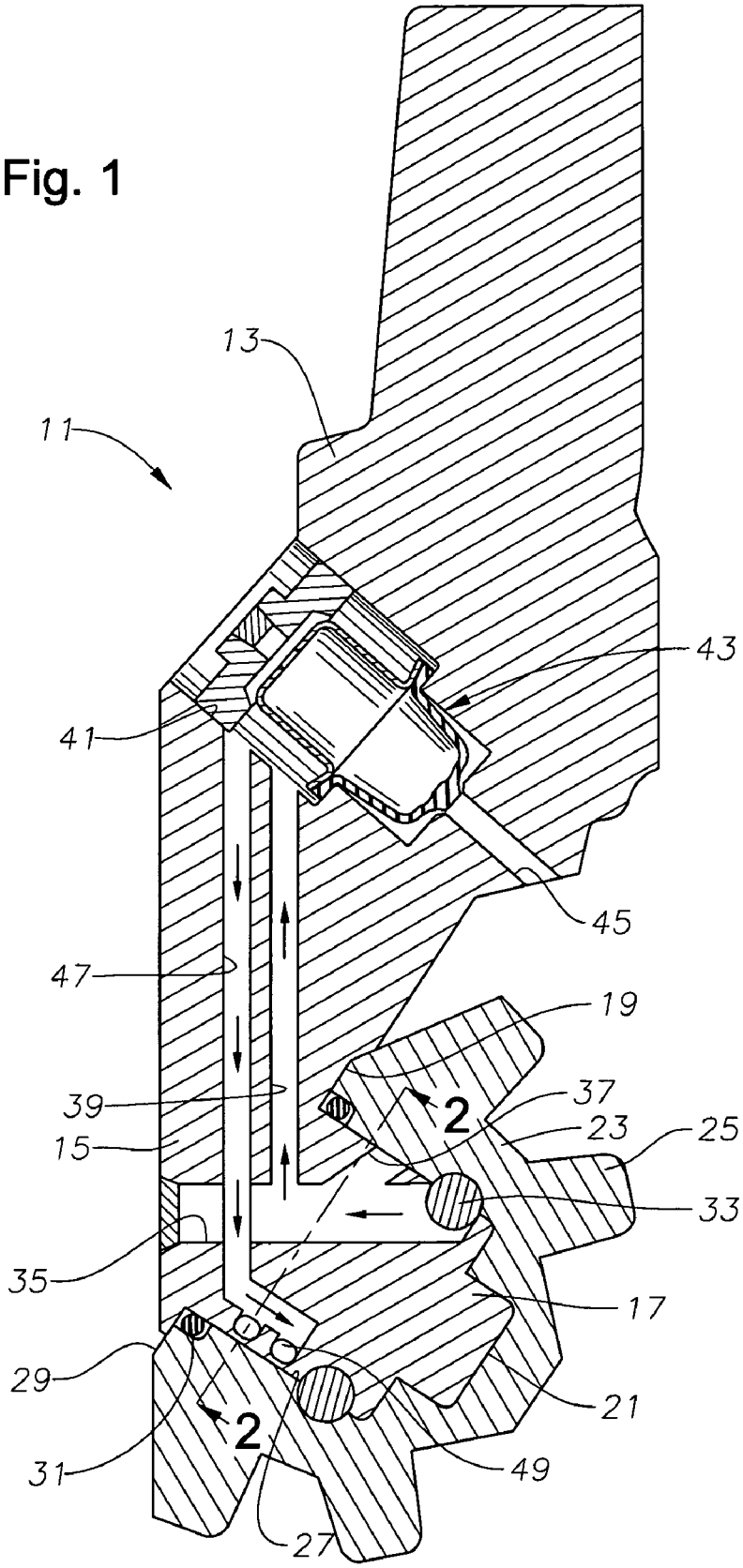
FIG. 1 is a quarter vertical view of an earth boring drill bit constructed in accordance with this invention.

Referring to FIG. 1, bit 11 has a body 13 at an upper end that is threaded (not shown) for attachment to the lower end of a drill string. Body 13 has at least one bit leg 15, typically three, which extend downward from it. Each bit leg 15 has a bearing pin 17 that extends downward and inward. Bearing pin 17 has an outer end, referred to as last machined surface 19, where it joins bit leg 15. Bearing pin 17 has a cylindrical journal surface 18 and a nose 21 of smaller diameter formed on its inner end.

A cone 23 rotatably mounts on bearing pin 17. Cone 23 has a plurality of protruding teeth 25 or compacts (not shown). Cone 23 has a cavity 27 that is slightly larger in diameter than the diameter of bearing pin 17. Cone 23 has a back face 29 that is located adjacent, but not touching, last machined surface 19. A seal 31 seals cavity 27 adjacent back face 29. Seal 31 may be of a variety of types, and in this embodiment is shown to be an O-ring. Seal 31 engages a gland or area of bearing pin 17 adjacent to last machined surface 19.

Cone 23 may be retained in more than one manner. In this embodiment, cone 23 is retained on bearing pin 17 by a plurality of balls 33 that engage a mating annular recess formed in cone cavity 27 and on bearing pin 17. Balls 33 lock cone 23 to bearing pin 17 and are inserted through a ball passage 35 during assembly after cone 23 is placed on bearing pin 17. Ball passage 35 extends to the exterior of bit leg 15 and is plugged after balls 33 are installed.

A portion of cavity 27 slidingly engages journal surface 18. The outer end of journal surface 18 is considered to be at the junction with the gland area engaged by seal 31, and the inner end of journal surface 18 is considered to be at the junction with the groove or race for balls 33. Journal surface 18 serves as a journal bearing for axial loads imposed on bit 11.

A first lubricant port 37 is located on an exterior portion of journal surface 18 of bearing pin 17. In the preferred embodiment, first port 37 is located on the upper or unloaded side of journal surface 18 of bearing pin 17 between balls 33 and seal 31. When viewed from nose 21 (FIG. 1), as shown in FIG. 2, first port 37 is shown at zero, which is top dead center. First port 37 could be on other areas of journal surface 18, but is preferably located in the range from zero to 90 degrees. First port 37 is connected to a first passage 39 via ball passage 35. First passage 39 leads to a lubricant reservoir 41 that contains a lubricant.

Lubricant reservoir 41 may be of a variety of types. In this embodiment, an elastomeric diaphragm 43 separates lubricant in lubricant reservoir 41 from a communication port 45 that leads to the exterior of bit body 13. Communication port 45 communicates the hydrostatic pressure on the exterior of bit 11 with pressure compensator 43 to reduce and preferably equalize the pressure differential between the lubricant and the hydrostatic pressure on the exterior.

A second passage 47 extends downward from lubricant reservoir 41, as well. Second passage 47 is separated from first passage 39 and leads to a second port 49. In the embodiment shown, second port 49 is a recess formed on the exterior of journal surface 18. Port 49 may comprise two separate but closely spaced ports as shown in FIG. 1, or it may be an elongated groove, or a single circular port. For convenience, second port 49 is referred to in the singular in this application. Second port 49 leads to the exterior of the lower side of journal surface 18 as shown in FIG. 2. Because the section plane in FIG. 1 is a vertical section, port 49 is not shown extending completely to the exterior of journal surface 18 in FIG. 1. The positioning along the axis of bearing pin 17 of second port 49 is at a midsection area of pin 17, approximately halfway between balls 33 and seal 31. As shown in FIG. 2, second port 49 intersects the exterior of journal surface 18 at a point that is in the range from about 185 degrees to 225 degrees, with zero being the top dead center. The particular embodiment shows second port 49 at 205 degrees.

The precise positioning may vary and is selected to take advantage of eccentricity. The eccentricity is a result of the difference between the outer diameter of journal surface 18 and the inner diameter of cone cavity 37. FIG. 2 shows the annular clearance 51 greatly exaggerated in FIG. 2. In actuality, annular clearance 51 is quite small, typically being no more than about 0.004" on a side. Annular clearance 51 is the same as in the prior art bits of this type. Under load, there will be a difference between axis 52 of bearing pin 17 and center point or axis 54 of cone 23. A particular bit 11 will have a maximum theoretical eccentric distance between axis 53 and axis 54 based on a maximum load. When operating, there will be an actual eccentric distance between axis 52 and axis 54 based on the actual load. The eccentricity ratio is the actual eccentric distance under a given load divided by the maximum eccentric distance possible. Under high loads, there will be some elastic deformation of bearing pin 17 and cone 23. The eccentricity ratio of bit 11 during operation preferably runs from about 0.9 to slightly greater than 1.0.

Even though very small, annular clearance 51 does have a largest width or clearance point 51*a* at approximately zero degrees and a minimum width or clearance point 51*b* at approximately at 180 degrees due to the downward force imposed on the bit during drilling. Assuming cone 23 rotates in the direction shown in FIG. 2 by the arrow, clearance 51 has a converging region 51*c* from zero to approximately 180 degrees, where the space for the lubricant gradually gets smaller. Clearance 51 has a diverging region 51*d*, from approximately 180 to zero degrees, where the space for the lubricant gets gradually larger. The minimum clearance point 51*b* is not typically zero because of lubricant located between bearing pin 17 and cone 23. At times during operation, minimum clearance point 51 may reach zero, but normally does not remain at zero. During operation, minimum clearance point 51*b* is typically slightly downstream or past 180 degrees a slight amount. The converging region 51*c* ends at minimum clearance point 51*b*, and the diverging region 51*d* begins at minimum clearance point 51*b*.

The lubricant within annular clearance 51 has a pressure profile, the pressure profile being the theoretical lubricant pressure at points circumferentially around annular clearance 51. Referring to FIG. 3, the theoretical lubricant pressure increases nonlinearly from zero degrees in the converging region 51*c* to a sharp positive peak 53*a*, which occurs in the converging region 51*c* just forward of minimum clearance point 51*b*. In actual drilling operations, the zero level in FIG. 3 will be a positive pressure, which is substantially at the hydrostatic pressure of the drilling fluid in the well bore. The maximum pressure point 53*a* is followed by an immediate or sharp pressure reduction zone or point 53*c*, which occurs at the beginning of the diverging region 51*d* immediately following minimum clearance point 51*b* (FIG. 2). Immediate reduction zone 53*c* drops to the level of the pressure within lubricant reservoir 41 (FIG. 1), which is approximately that of hydrostatic pressure in the well bore. The actual magnitude of positive pressure peak 53*a* depends on the weight imposed on the drill bit as well as other factors.

The dotted lines in FIG. 3 represent what the pressure profile would look like in a conventional drill bit bearing lacking port 49 (FIG. 2). The immediate pressure reduction zone 53*c* would proceed to a prior art level 53*b* that is theoretically the same magnitude as positive pressure peak 53*a* but negative relative to the hydrostatic pressure in the well bore. This prior art pressure profile is referred to as a full Sommerfeld solution. In this invention, the full Sommerfeld solution does not occur, rather immediate pressure reduction zone 53*c* drops only to approximately the ambient pressure in lubricant reservoir 41, which is the same as the hydrostatic pressure in the well bore. The reason for the difference between immediate reduction zone 53*c* and prior art level 53*b* is that second passage 47 and second port 49 communicate the higher pressure in lubricant reservoir 41 to annular clearance 51 approximately where the prior art level 53*b* would otherwise occur. Because of this communication path, immediate reduction zone 53*c* does not proceed to a large negative level relative to the pressure in lubricant reservoir 41, rather drops only to the ambient pressure in lubricant reservoir 41. Second port 49 is located in diverging region 51*d* closer to minimum clearance 51*b* than to maximum clearance 51*a* to cause this communication. Preferably, second port 49 is located approximately at immediate pressure reduction zone 53*c*.

A pressure profile that has the appearance of the solid line in FIG. 3 is known as a half Sommerfeld solution. In prior art journal bearings in general, the negative peak 53*b* may be eliminated by a process known as cavitation. Gas and vapor bubbles form in the lubricant and relieve the negative immediate reduction zone by filling volume as the lubricant passes through the divergent region of the bearing. Cavitation is a beneficial feature for a journal bearing as a result. However, in an earth boring bit, cavitation does not normally occur because the level of immediate reduction zone 53*b* is above the lubricant saturation and vapor pressures, even though it is negative relative to lubricant pressure in reservoir 41. This is the result of the hydrostatic pressure on the exterior of the drill bit. Second passage 47 and port 49 in FIG. 2 achieve the desirable half Sommerfeld effect for a drill bit even though actual cavitation does not occur.

Figure 4:
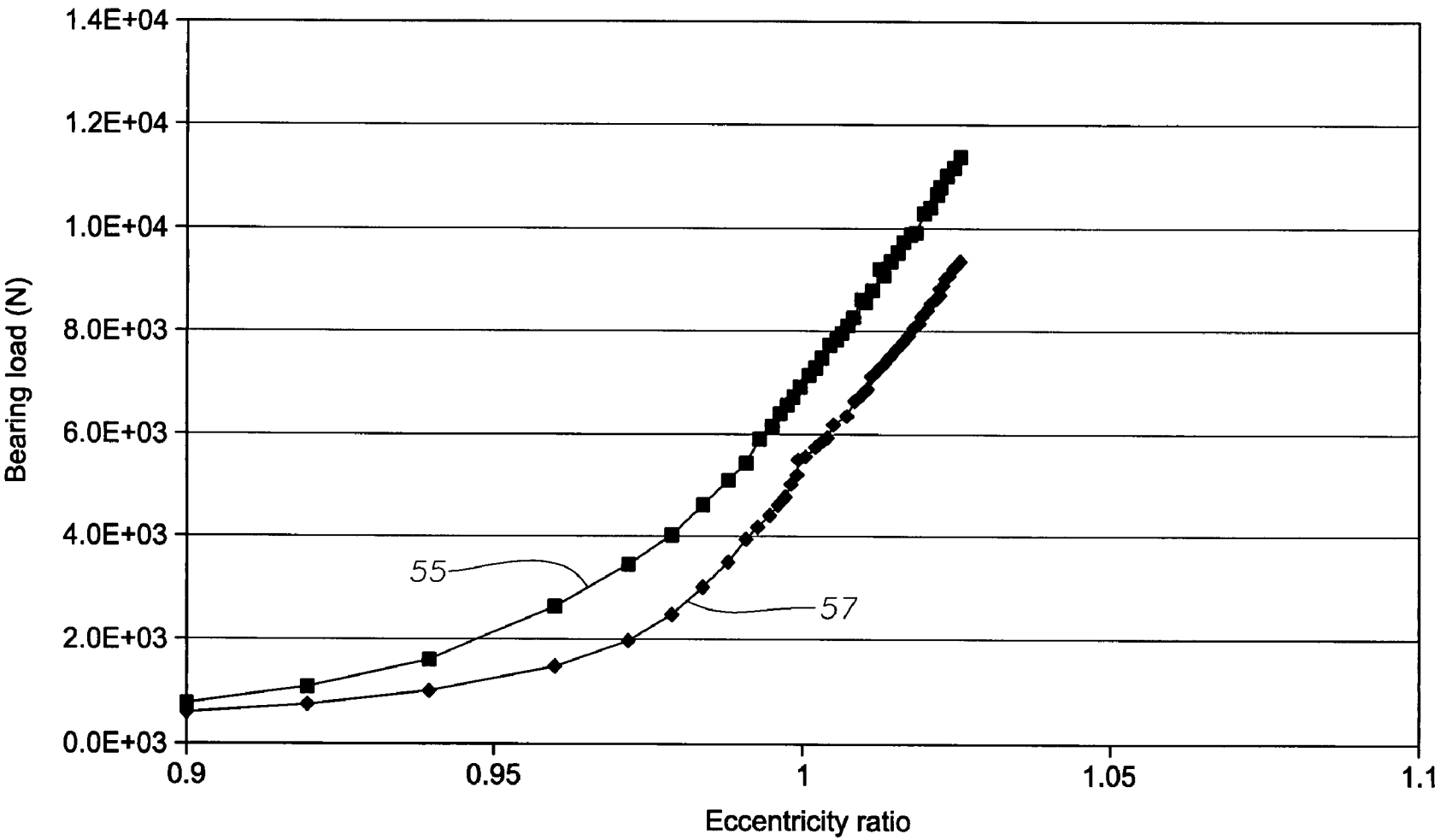
FIG. 4 is a graph of a bearing carrying capacity versus eccentricity ratio for a drill bit in accordance with this invention and a conventional drill bit.

Studies have shown that the load carrying ability for drill bit 11 is significantly improved if it has a theoretical pressure profile as indicated by curve 53 as opposed to full Sommerfeld, which would include negative immediate reduction zone 53*b*. FIG. 4 is a graph of bearing load versus eccentricity ratio for two different bits. In both cases, the load carrying capability increases as the eccentricity ratio increases. Curve 55 is a plot representing bit 11 of this invention, having passages 47 and ports 49 for each bearing. Curve 57 is a plot of a conventional bit that is the same as bit 11, but does not having a second passage 47 and a second port 49. This graph is a calculation that also includes the effects of side leakage, surface deformation and viscosity pressure effects. This simulation shows that the bearing represented by curve 55 is capable of carrying about a 20% greater load than a bearing represented by curve 57.

The placement of port 49 in the divergent region 51*d* will result in circulation of lubricant through the bearing cavities to reservoir 41. Referring to FIG. 3, the pressure difference between prior art level 53*b* and immediate reduction zone 53*c* causes this circulation. Lubricant flows around bearing pin 17 in the same direction as the direction of rotation. The lubricant flows from reservoir 41 through second passage 47 and out port 49. The lubricant flows around bearing pin 17 and returns through first port 37 and ball passage 35 back to first passage 39. Drill bits such as drill bit 11 are typically rotated at about 60 to 200 rpm. The speed of rotation of each cone 23 is approximately 1.5 times the bit rotational speed. Rotation has an effect on pressure profile 53, causing the maximum pressure point to increase in magnitude. The maximum pressure level also increases with eccentricity ratio. These effects cause the pumping or circulation to increase, increasing the flow rate.

Figure 5:
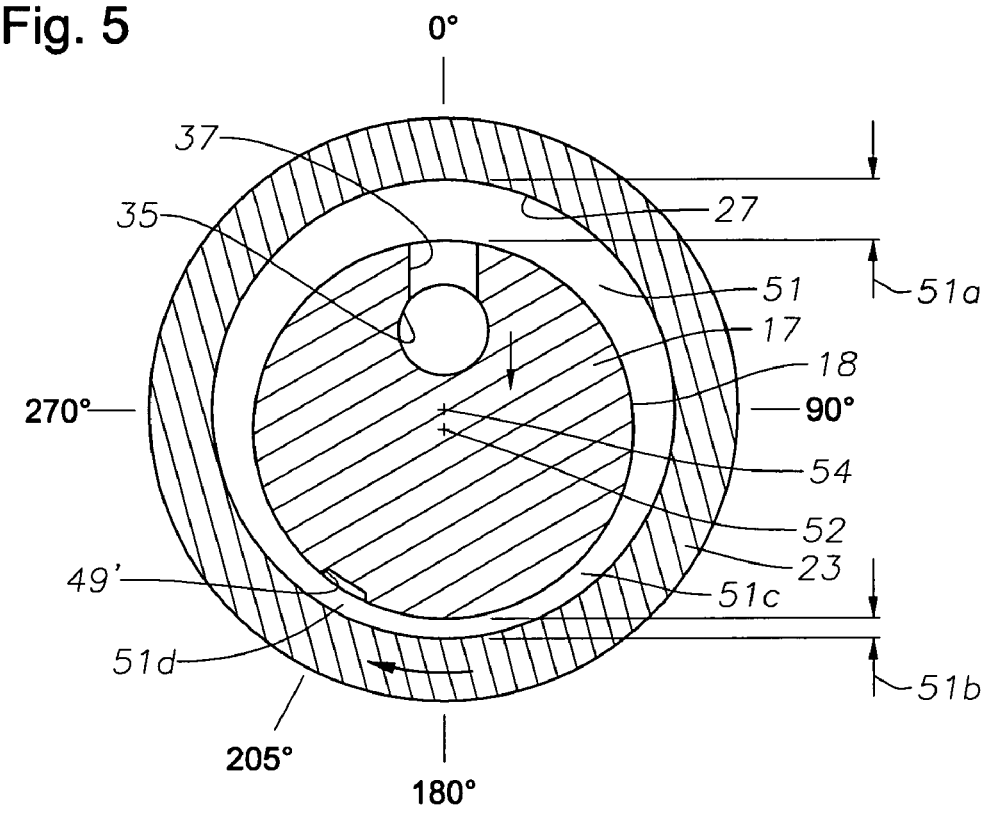
FIG. 5 is a sectional view similar to FIG. 2, but of an alternate embodiment of a drill bit.

A second embodiment, shown in FIG. 5, is numbered the same as the first embodiment except for the different features. Port 49' differs from port 49 of the first embodiment in that there is no second passage leading to it, unlike passage 47. Port 49 is a recess that may be of a variety of shapes. Port 49 preferably comprises an elongated groove that extends a substantial portion of the length of journal surface 18 from last machined surface 19 (FIG. 1) to the groove for balls 33. Port 49' is located at the same position circumferentially as port 49 of the first embodiment. Port 49' provides additional volume in the annular clearance 51 at the immediate reduction zone 53*c*, preventing or reducing a pressure spike that is negative relative to the pressure in the lubricant reservoir 41 (FIG. 1).

Figure 6:
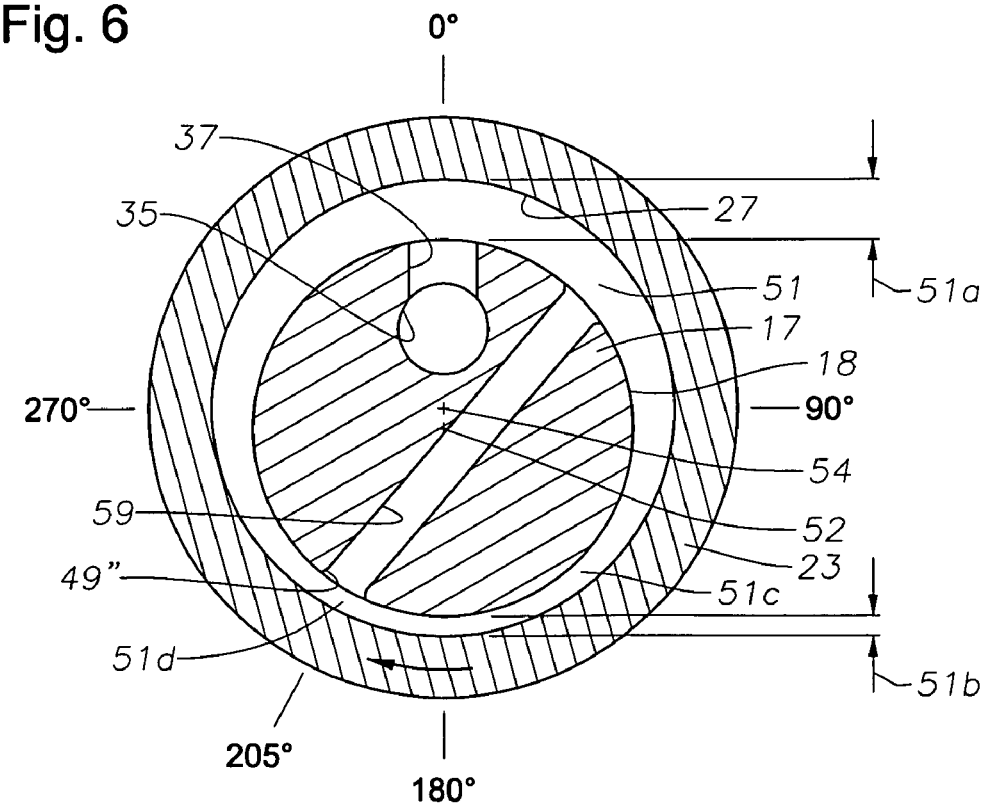
FIG. 6 is a sectional view similar to FIG. 2, but of another alternate embodiment of a drill bit.

A third embodiment is shown in FIG. 6. Port 49" may be the same type of recess as port 49' in the second embodiment, or a plurality of ports similar to port 49 in the first embodiment. A passage 59 leads from port 49" to the exterior of bearing pin 17 on the unloaded side. Preferably, passage 59 leads to a place near top dead center of bearing pin 17 on the converging side of the maximum clearance point 51*a*. The pressure in clearance 51 in this vicinity is substantially the same as the pressure in reservoir 41 (FIG. 1). This communication of reservoir pressure to port 49" reduces or eliminates the negative spike 53*b*, thus increasing the bearing capacity.

The invention has significant advantages. The recess on the lower side of the bearing pin in the diverging zone increases the bearing capacity by reducing or eliminating a pressure reduction in the divergent zone that is less than pressure in the lubricant reservoir. Also, one embodiment enhances circulation of lubricant throughout the system, which distributes wear particles and assures a supply of lubricant to the various portions of the bearing pin.

While the invention has been shown in only three of its forms, it should be apparent to those skilled in the art that it is not so limited but is susceptible to various changes without departing from the scope of the invention.

The invention claimed is:

1. In an earth boring bit having a bit body with at least one depending leg, a cylindrical bearing pin extending from the leg, a rotatable cone having a cylindrical cavity that fits slidingly on a journal surface of the bearing pin, the improvement comprising:

a recess on an exterior portion of the journal surface tat is in the range from 185 to 225 degrees as seen from an inner end of the bearing pin, the recess being located between a seal and a locking element groove of the cylindrical bearing pin and the recess being hollow to trap lubricant therein.

2. The bit according to claim 1, wherein during operation of the drill bit, a lubricant pressure profile measured circumferentially around a clearance surrounding the bearing pin has a maximum positive peak followed by an immediate reduction zone to a minimum amount, and wherein the recess is located substantially at the immediate reduction zone.

3. The bit according to claim 1, further comprising:

a lubricant chamber comprising a lubricant reservoir in the body for containing the lubricant, and an annular clearance surrounding the journal surface;

a pressure compensator in the reservoir for reducing pressure differential between the lubricant in the reservoir and hydrostatic pressure surrounding the bit; and a passage leading from the recess through the bearing pin to a position in the lubricant chamber that is substantially at the same pressure as that in the lubricant reservoir.

4. The bit according to claim 1, further comprising a passage leading from the recess through the bearing pin to an unloaded side of the bearing pin.

5. The bit according to claim 1, further comprising:

a lubricant chamber comprising a lubricant reservoir in the body for containing the lubricant, and an annular clearance surrounding the bearing pin;

a pressure compensator in the reservoir for reducing pressure differential between the lubricant in the reservoir and hydrostatic pressure surrounding the bit;

a first passage leading from the reservoir to an exterior portion of the bearing pin; and a second passage leading from the recess to the reservoir.

6. An earth boring bit, comprising:

a bit body having at least one depending leg;

a cylindrical bearing pin extending from the leg along a bearing pin axis;

a rotatable cone having a cylindrical cavity that fits slidingly on a journal surface of the bearing pin, defining an annular clearance between the cavity and the journal surface, wherein weight imposed on the bit during drilling causes the annular clearance to be greater on an upper portion of the journal surface than on a lower portion of the journal surface;

a lubricant reservoir in the body;

a pressure compensator mounted to the body for reducing pressure differential between hydrostatic drilling fluid pressure exterior of the bit and pressure in the lubricant reservoir;

a recess on an exterior portion of the journal surface between inner and outer ends of the journal surface; and wherein during operation of the drill bit, a lubricant pressure profile measured circumferentially around the clearance has a maximum positive peak followed by an immediate reduction zone to substantially the pressure of the lubricant in the lubricant reservoir, and wherein the recess is located substantially at the occurrence of the immediate reduction zone.

7. The bit according to claim 6, further comprising;

a passage leading from the recess through the bearing pin to a position in the lubricant chamber that is substantially at the same pressure as that in the lubricant reservoir.

8. The bit according to claim 6, further comprising a passage leading from the recess through the bearing pin to an unloaded side of the bearing pin.

9. The bit according to claim 6, further comprising:

a first passage leading from the reservoir to an exterior portion of the bearing pin; and a second passage leading from the recess to the reservoir.

10. An earth boring bit, comprising:

a bit body having at least one depending leg;

a cylindrical bearing pin having an outer end joined to the leg and an inner end, the bearing pin extending downward and inward relative to an axis of rotation of the bit;

a rotatable cone having a cylindrical cavity that fits slidingly on a journal surface of the bearing pin, a lubricant reservoir in the body;

a pressure compensator mounted to the body for reducing pressure differential between hydrostatic drilling fluid pressure exterior of the bit and pressure in the lubricant reservoir;

wherein under operating loads, the cone becomes eccentric relative to the bearing pin, resulting in an annular clearance between the cone and the journal surface that has a converging zone leading to a minimum clearance point and a diverging zone leading from the minimum clearance point to an unloaded side of the journal surface; and a recess located on the journal surface in a central area between inner and outer ends of the journal surface in the diverging zone closer to the minimum clearance point than the maximum clearance point.

11. The bit according to claim 10, wherein the bit has a lubricant pressure profile during operation that has a maximum positive peak in the converging zone near the minimum clearance point and an immediate reduction zone in the diverging zone near the minimum clearance point, and the recess is located at the immediate reduction zone.

12. The bit according to claim 10, further comprising:

a passage leading from the recess through the bearing pin to a position in the lubricant chamber that is substantially at the same pressure as that in the lubricant reservoir.

13. The bit according to claim 10, further comprising a passage leading from the recess through the bearing pin to an unloaded side of the bearing pin.

14. The bit according to claim 10, further comprising:

a first passage leading from the reservoir to an exterior portion of the bearing pin; and a second passage leading ftom the recess to the reservoir.

15. In an earth boring bit having a bit body with at least one depending leg, a cylindrical bearing pin extending from the leg, a rotatable cone having a cylindrical cavity that fits slidingly on a journal surface of the bearing pin, a lubricant reservoir in the body, and a first passage leading from the lubricant reservoir to an exterior portion of the bearing pin, the improvement comprising:

a second passage leading from the reservoir to a port on an exterior portion of the journal surface that is in the range from 185 to 225 degrees as seen from an inner end of the bearing pin.

16. The bit according to claim 15, wherein during operation of the drill bit, a lubricant pressure profile measured circumferentially around the clearance has a maximum positive peak followed by an immediate reduction zone to a minimum amount, and wherein the port of the second passage is located substantially at the immediate reduction zone.

17. The bit according to claim 15, wherein the port of the second passage is in a midsection area between a last machined surface of the bearing pin and an inner end of the journal surface.

18. An earth boring bit, comprising:

a bit body having at least one depending leg;

a cylindrical bearing pin extending from the leg along a bearing pin axis;

a rotatable cone having a cylindrical cavity that fits slidingly on a journal surface of the bearing pin, defining an annular clearance between the cavity and the journal surface, wherein weight imposed on the bit during drilling causes the annular clearance to be greater on an upper portion of the journal surface than on a lower portion of the journal surface;

a lubricant reservoir in the body;

a pressure compensator mounted to the body for reducing pressure differential between hydrostatic drilling fluid pressure exterior of the bit and pressure in the lubricant reservoir;

a first passage leading from the reservoir to a port on an exterior portion of the bearing pin;

a second passage separate from the first passage and leading from the reservoir to a port on an exterior portion of the journal surface for supplying lubricant from the reservoir to the annular clearance; and wherein during operation of the drill bit, a lubricant pressure profile measured circumferentially around the clearance has a maximum positive peak followed by an immediate reduction zone to substantially the pressure of the lubricant in the lubricant reservoir, and wherein the port of the second passage is located substantially at the occurrence of the immediate reduction zone.

19. The bit according to claim 18, wherein the port of the second passage is located at a point in the range from 185 to 225 degrees when facing an inner end of the bearing pin.

20. An earth boring bit, comprising:

a bit body having at least one depending leg;

a cylindrical bearing pin having an outer end joined to the leg and an inner end, the bearing pin extending downward and inward relative to an axis of rotation of the bit;

a rotatable cone having a cylindrical cavity that fits slidingly on a journal surface of the bearing pin, a lubricant reservoir in the body;

a pressure compensator mounted to the body for reducing pressure differential between hydrostatic drilling fluid pressure exterior of the bit and pressure in the lubricant reservoir;

a first passage leading from an exterior portion of the bearing pin to the reservoir, wherein under operating loads, the cone becomes eccentric relative to the bearing pin, resulting in an annular clearance between the cone and the journal surface that has a converging zone leading to a minimum clearance point and a diverging zone leading from the minimum clearance point to an unloaded side of the journal surface;

a second passage leading from the reservoir to a portion of the journal surface in the diverging zone closer to the minimum clearance point than the maximum clearance point.

21. The bit according to claim 20, wherein the second passage terminates on the journal surface in the range from 185 to 225 degrees when facing the inner end of the bearing pin, with zero being top dead center of the bearing pin.

22. The bit according to claim 20, wherein the second passage terminates in a midsection area between the inner and outer ends of the journal surface.

23. The bit according to claim 20, wherein the bit has a lubricant pressure profile during operation that has a maximum positive peak in the converging zone near the minimum clearance point, and an immediate reduction zone in the diverging zone near the minimum clearance point, and the port of the second passage is located at the immediate reduction zone.

* * * * *